US010288333B2

(12) United States Patent
Carrubba et al.

(10) Patent No.: US 10,288,333 B2
(45) Date of Patent: May 14, 2019

(54) REFRIGERATION CHARGING DEVICES AND METHODS OF USE THEREOF

(71) Applicant: THE ARMOR ALL/STP PRODUCTS COMPANY, Danbury, CT (US)

(72) Inventors: Vincent Carrubba, Belle Harbor, NY (US); Kenneth Alan Pistone, Rowlett, TX (US)

(73) Assignee: THE ARMOR ALL/STP PRODUCTS COMPANY, Danbury, CT (US)

( * ) Notice: Subject to any disclaimer, the term of this patent is extended or adjusted under 35 U.S.C. 154(b) by 0 days.

(21) Appl. No.: 15/623,705

(22) Filed: Jun. 15, 2017

(65) Prior Publication Data

US 2017/0284716 A1 Oct. 5, 2017

Related U.S. Application Data

(63) Continuation of application No. 14/453,270, filed on Aug. 6, 2014, now Pat. No. 9,709,307.

(60) Provisional application No. 61/863,107, filed on Aug. 7, 2013.

(51) Int. Cl.
*F25B 45/00* (2006.01)

(52) U.S. Cl.
CPC ..... *F25B 45/00* (2013.01)

(58) Field of Classification Search
CPC ..... F25B 45/00; F25B 41/062; F25B 41/043; F16K 1/308; F16K 11/0712; F16K 31/406
See application file for complete search history.

(56) References Cited

U.S. PATENT DOCUMENTS

| | | | |
|---|---|---|---|
| 1,420,997 | A | 6/1922 | Freeman |
| 1,666,283 | A | 4/1928 | Farley |
| 1,799,727 | A | 4/1931 | Byars |
| 2,001,233 | A | 5/1935 | Anderberg |
| 2,040,868 | A | 5/1936 | Moody |
| 2,285,569 | A | 6/1942 | Crowley |
| 2,635,623 | A | 4/1953 | Moffett |
| 2,658,383 | A | 11/1953 | Chipley |
| 3,214,860 | A | 11/1965 | Johnson |

(Continued)

OTHER PUBLICATIONS

International Search Report dated Jan. 27, 2015 from corresponding PCT/US2014/049951, pp. 5.

(Continued)

*Primary Examiner* — Emmanuel Duke
(74) *Attorney, Agent, or Firm* — Kagan Binder, PLLC

(57) ABSTRACT

Servicing devices and methods of use for servicing refrigerant systems are described herein. A servicing device may include a body and actuator. The body includes a first fluid port that is coupleable to a fluid port of a fluid source; a second fluid port, that is operatively couples to a refrigeration system; a passage in fluid communication with the first and second fluid ports and in fluid communication; and a plunger at least partially disposed in the passage of the body, and the plunger is adjustable between a released position and an engaged position, during use. The actuator is coupled to the body, and, during use, downward movement the actuator raises or lowers a plunger such that substantially continuous fluid communication between the first fluid port and the second fluid port is established.

17 Claims, 6 Drawing Sheets

(56) References Cited

U.S. PATENT DOCUMENTS

| | | | | |
|---|---|---|---|---|
| 3,490,275 | A | 1/1970 | Walker | |
| 3,645,496 | A | 2/1972 | Rawlins | |
| 3,686,954 | A | 8/1972 | Motl | |
| 3,916,641 | A | 11/1975 | Mullins | |
| 3,933,156 | A | 1/1976 | Riggi | |
| 4,110,998 | A | 9/1978 | Owen | |
| 4,116,245 | A | 9/1978 | Ayers | |
| 4,338,793 | A | 7/1982 | O'Hern, Jr. | |
| 4,535,802 | A | 8/1985 | Robertson | |
| 4,877,052 | A | 10/1989 | Toshio et al. | |
| 5,046,322 | A | 9/1991 | Bulla et al. | |
| 5,070,917 | A | 12/1991 | Ferris et al. | |
| 5,167,140 | A | 12/1992 | Cooper et al. | |
| 5,172,562 | A | 12/1992 | Manz et al. | |
| 5,222,369 | A | 6/1993 | Hancock et al. | |
| 5,231,841 | A | 8/1993 | McClelland et al. | |
| 5,493,869 | A | 2/1996 | Shirley et al. | |
| 5,540,254 | A | 7/1996 | McGowan et al. | |
| 5,827,050 | A | 10/1998 | Price | |
| 5,878,774 | A | 3/1999 | Zanetti | |
| 5,878,781 | A | 3/1999 | Parker | |
| 5,967,204 | A | 10/1999 | Ferris et al. | |
| 5,975,151 | A | 11/1999 | Packo | |
| 5,999,700 | A | 12/1999 | Geers | |
| 6,089,032 | A | 7/2000 | Trachtenberg | |
| 6,155,066 | A | 12/2000 | Chandler et al. | |
| 6,253,810 | B1 | 7/2001 | Trigiani | |
| 6,260,739 | B1 | 7/2001 | Hsiao | |
| 6,338,288 | B1 | 1/2002 | Spadaccini et al. | |
| 6,360,554 | B1 | 3/2002 | Trachtenberg | |
| 6,385,986 | B1 * | 5/2002 | Ferris | B60H 1/00585 62/292 |
| 6,438,970 | B1 | 8/2002 | Ferris et al. | |
| 6,442,958 | B1 | 9/2002 | Knowles | |
| 6,446,453 | B1 | 9/2002 | Trachtenberg | |
| 6,467,283 | B1 | 10/2002 | Trachtenberg | |
| 6,481,221 | B2 | 11/2002 | Ferris et al. | |
| D470,863 | S | 2/2003 | Williams | |
| 6,539,988 | B1 | 4/2003 | Cowan et al. | |
| 6,609,385 | B1 * | 8/2003 | Ferris | B60H 1/00585 62/149 |
| 6,648,035 | B1 | 11/2003 | Cowan et al. | |
| 6,698,466 | B1 | 3/2004 | Cowan et al. | |
| 6,722,141 | B2 | 4/2004 | Ferris et al. | |
| 6,745,591 | B1 | 6/2004 | Lin | |
| 6,796,340 | B1 | 9/2004 | Ferris et al. | |
| 6,978,636 | B2 | 12/2005 | Motush et al. | |
| 6,981,622 | B2 | 1/2006 | Brody | |
| 7,107,781 | B2 | 9/2006 | Quest et al. | |
| 7,124,598 | B2 | 10/2006 | Quest et al. | |
| 7,260,943 | B2 | 8/2007 | Carruba et al. | |
| 7,275,383 | B2 | 10/2007 | Motush et al. | |
| 8,875,524 | B1 * | 11/2014 | Parnell | F25B 45/00 62/292 |
| 2004/0168463 | A1 * | 9/2004 | Dudley | B60H 1/00585 62/292 |
| 2005/0061014 | A1 | 3/2005 | Cannan | |
| 2008/0022701 | A1 | 1/2008 | Carruba | |
| 2009/0113901 | A1 | 5/2009 | Carruba et al. | |
| 2011/0041522 | A1 | 2/2011 | Carrubba | |
| 2011/0284124 | A1 * | 11/2011 | Huang | B60S 5/04 141/38 |
| 2012/0192576 | A1 * | 8/2012 | Carrubba | B60H 1/00585 62/77 |
| 2012/0192579 | A1 | 8/2012 | Huff et al. | |
| 2013/0118187 | A1 * | 5/2013 | Carrubba | F25B 45/00 62/77 |

OTHER PUBLICATIONS

International Written Opinion dated Jan. 27, 2015 from corresponding PCT/US2014/049951, pp. 7.

International Preliminary Report on Patentability dated Aug. 11, 2015 from PCT/US2014/049951, pp. 10.

* cited by examiner

REFRIGERATION CHARGING DEVICES AND METHODS OF USE THEREOF

RELATED APPLICATION

This application is a continuation of U.S. patent application Ser. No. 14/453,270, filed Aug. 6, 2014, which claims the benefit of U.S. patent application Ser. No. 61/863,107, filed Aug. 7, 2013, both of which are incorporated herein by reference.

BACKGROUND OF THE DISCLOSURE

1. Field of the Disclosure

This disclosure relates to servicing devices. In particular, this disclosure relates to servicing devices for charging refrigeration systems.

2. Description of the Related Art

Refrigeration systems (e.g., air-conditioning (A/C) systems) typically include a liquid or gaseous refrigerant that is used for cooling. Servicing a refrigeration system (for example, an automobile refrigerant system, a residential refrigerant system, or a commercial refrigeration system) often includes charging the system with a refrigerant (for example, halogenated hydrocarbons, and/or other coolants). In the case of charging an automobile refrigerant system, a pressurized refrigerant source, such as an aerosol can of refrigerant, connects via a hose to a low-pressure port of refrigerant lines carrying refrigerant within the system. While connected, the refrigerant may expel from the refrigerant source and is injected or drawn into the refrigerant lines. Refrigerant may be added until the desired amount of refrigerant is achieved in the system.

After market servicing of air conditioners is conventionally done by owners of vehicles commonly known as the "do-it-yourself" or the DIY market. A common technique for adding a relatively small quantity of refrigerant (for example, a can of refrigerant) to a refrigerant circuit of an air conditioning system, is to interconnect a charging hose assembly between a suction line service fitting on the refrigerant circuit and a small canister filled with pressurized refrigerant, and then flow at least some of the refrigerant from the canister into the circuit during operation of the system.

In most conventionally manufactured version thereof, the valve used to regulated the flow of refrigerant is either capable of opening a self-sealing valve of a refrigerant can and/or is a piercing dispensing shut-off valve connected to one of a hose and a disconnect coupler fitting connect to the opposite end of the hose. To use the charging hose assembly, the shut-off valve is screwed onto a cylindrical outlet portion of the canister, and the coupler fitting is releasably locked onto the service fitting. When this is done, a fixed pin member within the coupler fitting depresses a corresponding opening pin within the service fitting to communicate the interior of the refrigerant circuit with the interior of the charging hose.

Next, the vehicle's engine is started, and the air conditioning system is operated in its maximum cooling mode. A handle on the installed shut-off valve of the charging device is then rotated in a first direction to cause an associated valve stem portion of the valve to pierce the outlet portion of the canister, and then the handle is rotated in the opposite direction to open the valve to allow fluid communication between the canister and the automobile refrigerant system.

To terminate the refrigerant charging process, the handle of the shut-off valve is rotated in the first direction to close the shut-off valve and thereby block the flow through the hose of any pressurized refrigerant remaining in the canister. The disconnect coupler fitting is then removed from the refrigerant circuit service fitting. If the canister has been completely emptied of refrigerant in this process, the shut-off valve is then removed from the canister and empty canister is discarded.

Many apparatus have been designed to allow the consumer to add refrigerant as needed to refrigerant systems. For example, U.S. Pat. Nos. 5,967,204 to Ferris et al.; 6,360,554 to Trachtenberg; 6,385,986 to Ferris et al.; 6,438,970 to Ferris et al.; 6,481,221 to Ferris et al.; 6,539,988 to Cowen et al., 6,609,385 to Ferris et al.; 6,648,035 to Cowen et al.; 6,698,466 to Cowen et al; 6,722,141 to Ferris et al.; 6,796,340 to Ferris et al.; 7,107,781 to Quest et al.; 7,124,598 to Quest et al.; 7,260,943 to Carrubba et al.; 7,275,383 to Motush et al.; and U.S. Patent Application Publication Nos. 2008-0022701 to Carrubba et al.; 2009-0113901 to Carrubba et al.; 2011-0041522 to Carrubba; 2012-0192579 to Carrubba, and 2013-0118187 to Carrubba, all of which are incorporated herein by reference as fully set forth herein, describe various apparatus that may allow a consumer to add refrigerant as needed and/or to measure the refrigerant pressure in an automobile air conditioner during the addition of the refrigerant. These devices, however, may be cumbersome for the consumer to use, as they may require the use of two hands to manage the dispensing of refrigerant from the canister. Thus, less cumbersome and more ergonomic refrigerant systems are desired.

The present disclosure provides many advantages, which shall become apparent as described below.

SUMMARY OF THE DISCLOSURE

Methods, systems, and devices for servicing a refrigeration system are described herein. A device for servicing a refrigerant system that includes a body and an actuator. The body includes a first fluid port that is coupleable to a fluid port of a fluid source; a second fluid port, that operatively couples to a refrigeration system; a passage in fluid communication with the first and second fluid ports and in fluid communication; and a plunger at least partially disposed in the passage of the body, and the plunger is adjustable between a released position and an engaged position, during use. The actuator is coupled to the body, and, during use, downward movement and rotation of the actuator engages the plunger such that substantially continuous fluid communication between the first fluid port and the second fluid port is established. In some embodiments, the fluid source is configured to be hand-held and the downward movement and rotation of the actuator is performed by a portion of the hand that is holding the fluid source.

In some embodiments, a method of servicing a refrigeration system includes providing a first fluid port of a servicing device to a fluid port of a fluid source; providing a second fluid port of the servicing device to a fluid port of a refrigeration system; opening the fluid source by piercing a seal of the fluid source with a portion of a bore of the servicing device; engaging a protrusion of a plunger of the servicing device with a portion of a body of the servicing device to inhibit axial movement of the plunger; and allowing substantially continuous fluid flow between the fluid source, through the body of the servicing device, and then to the refrigeration system.

In some embodiments, a device for servicing a refrigeration system, including a body and an actuator. The body includes a first fluid port that operatively couples to a fluid source; a piercing member that is capable of piercing a seal of the fluid source; a second fluid port that operatively couples to a fluid port of refrigeration system; and a plunger at least partially disposed in the passage of the body, a first portion of the plunger is configured to seal the second fluid port during use, and the plunger is adjustable between an open and closed position during use. The actuator couples to the body and during use, downward movement of the actuator moves the first portion of the plunger to allow fluid communication between the first fluid port and the second fluid port. The fluid source is configured to be hand-held and the downward movement of the actuator is performed by a portion of the hand that is holding the fluid source.

In some embodiments, a method of servicing a refrigeration system includes providing a first fluid port of a servicing device to a fluid port of a fluid source; providing a second fluid port of the servicing device to a fluid port of a refrigeration system, wherein a portion of a plunger of the servicing device seals the second fluid port; contacting a piercing member of the servicing device with a seal a fluid source to open the fluid source; providing the fluid source to a first portion of a hand of a user; and actuating a lever of the servicing device with second portion of the hand to move the plunger such that fluid communication between the refrigeration system the fluid source is established.

In some embodiments, kits that include apparatus and/or devices for servicing refrigeration systems are described herein.

In further embodiments, additional features may be added to the specific embodiments described herein.

Further objects, features and advantages of the present disclosure will be understood by reference to the following drawings and detailed description.

BRIEF DESCRIPTION OF THE DRAWINGS

The present invention will be better understood and other advantages will appear on reading the detailed description of some embodiments taken as non-limiting examples and illustrated by the following drawings.

Figure 1:
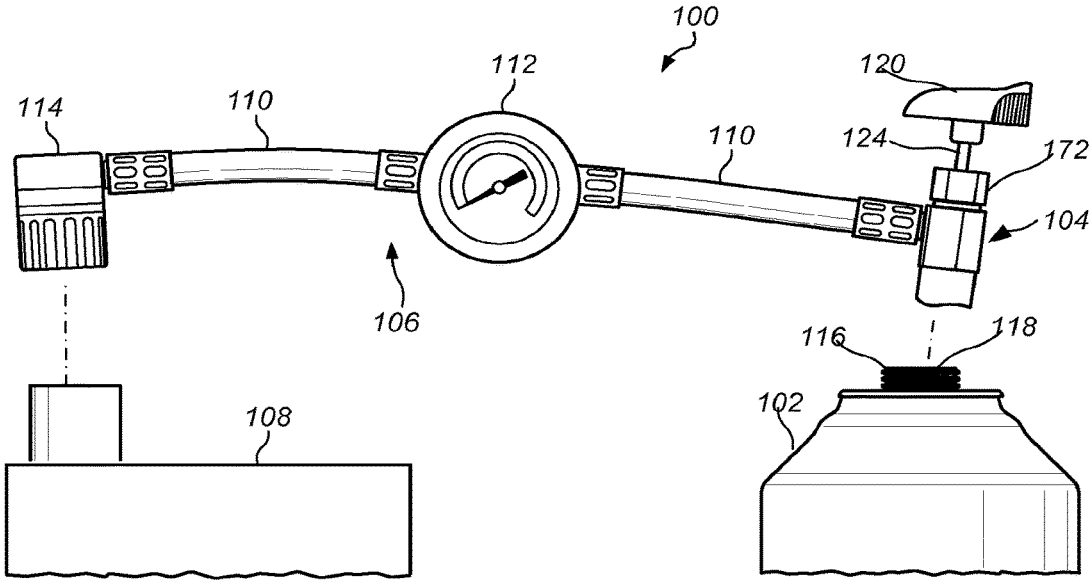
FIG. 1 is a schematic view of an embodiment of a fluid routing system.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF THE PREFERRED EMBODIMENTS

It is to be understood that the present invention is not limited to particular devices or methods, which may, of course, vary. It is also to be understood that the terminology used herein is for describing particular embodiments only, and is not intended to be limiting. As used in this specification and the appended claims, the singular forms "a", "an", and "the" include singular and plural referents unless the content clearly dictates otherwise. Thus, for example, reference to "a fluid" may include a combination of two or more fluids. Furthermore, the word "may" is used throughout this application in a permissive sense (i.e., having the potential to, being able to), not in a mandatory sense (i.e., must). The term "include," and derivations thereof, mean "including, but not limited to." Terms relating to orientation, such as "upper", "lower", "top", "bottom", "left", or "right", are used for reference only; the device herein may be used in any orientation. The order of any method may be changed, and various elements may be added, reordered, combined, omitted, modified, etc.

"Bias member" refers to any member of the system, device, or apparatus that exerts a force in a particular direction(s).

"Body" refers to any physical structure capable of at least partially supporting another object. A body may have various regular or irregular shapes. For example, portions of a body may be straight, curved, or a combination of both.

"Charging" refers to both charging and recharging of a system. Charging a system may include initially filling a unit with fluid (for example, refrigerant). Recharging may refer to adding fluid to a unit that has some fluid in the unit. Recharging may be performed after a portion of the fluid has leaked out of the unit or the pressure/amount of the fluid has dropped below a desirable level. It will be appreciated that charging and recharging are often used interchangeably.

"Coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

"Coupling element" refers to any physical structure or combination of structures capable of releasably or permanently connecting two objects. Examples of a coupling element include, but are not limited to, a hook, a clip, a clasp, mating threads, one or more members of an interference fitting, one or more members of a welded joint, one or more members of a quick coupling joint, and any combination of such elements.

"Fluid" refers to a liquid, gas, vapor, or a mixture thereof.

"Member" refers to a constituent part of a system. A member may include a plate, link, rod, or other structure of various sizes, shapes, and forms. A member may be a single component or a combination of components coupled to one another. A member may have various regular or irregular shapes. For example, portions of a member may be straight, curved, or a combination of both.

"Opening" refers to an aperture, such as a hole, gap, slit, or slot.

In some embodiments, a servicing device is connected to a fluid source and a fluid receiving system. The fluid source may include a self-sealing valve. The servicing device is capable of allowing fluid communication between the fluid source and the fluid receiving system. The servicing device may include a plunger that is capable of engaging the self-sealing valve. Use of a servicing device that couples directly to a fluid source and engages with a self-sealing valve may eliminate the need for adaptors used to adapt conventional valves to refrigerant containers having integrated valves. In some embodiments, the servicing device is capable of being locked in an open position during use.

In some embodiments, the servicing device includes a measuring device. The servicing device may allow fluid communication between the measuring device and the fluid receiving system while inhibiting fluid communication between the fluid source and the measuring device and/or the fluid receiving system.

FIG. 1 is a perspective side view of an embodiment of a fluid routing system. Fluid routing system 100 may include one or more valves, hoses, pressure gauges, check valves, flexible or rigid conduits, adapters, or combinations thereof. Fluid routing system 100 includes fluid source 102, servicing device 104, fluid transfer member 106, and fluid receiving system 108. Fluid source 102 may be coupled to fluid receiving system 108 via servicing device 104 and fluid transfer member 106. As shown, fluid source 102 is connected to servicing device 104, the servicing device is connected to fluid transfer member 106, and the fluid transfer member is connected to fluid receiving system 108.

In some embodiments, fluid routing system 100 is capable of transferring fluid from fluid source 102 to fluid receiving system 108. For example, fluid source 102 may have an internal pressure sufficiently greater than that of fluid receiving system 108 such that fluid flows from the fluid source to the fluid receiving system. In certain embodiments, a refrigerant may be added to a refrigeration system using one or more components of fluid routing system 100.

Fluid source 102 may include a volume of hydrocarbons, halogenated hydrocarbons, or mixtures thereof. In some embodiments, fluid source may include ammonia and/or water. Halogenated hydrocarbons include, but are not limited to, fluorinated hydrocarbons, chlorinated, fluorinated hydrocarbons, fluorinated ethers, 2,3,3,3-tetrafluorprop-1-ene (HF0-1234yf), 1,1,1,2-tetrafluorethane, dichlorodifluoromethane, or mixtures thereof. Commercially available fluid sources include, but are not limited to, HF0-1234yf refrigerants (for example, Genetron 0 (Honeywell, USA), Opteon™ (DuPont™, USA), R-134a, R-12, or the like. In some embodiments, fluid source 102 may also include other suitable chemicals including, but not limited to, dyes and/or system lubricants.

Fluid source 102 may be any suitable shape or size and/or may be composed of one or more suitable materials. Fluid source 102 may have a shape that is easily grasped by a human hand, sufficient size to contain a desired volume of fluid; and/or may be composed of a material having sufficient mechanical properties to withstand the static force of a pressurized fluid.

In certain embodiments, fluid source 102 is a portable container. A portable container includes, but is not limited to, a can, a cylinder, or a reservoir that is easily handled by a user. In some embodiments, fluid source 102 includes, but is not limited to, a stationary reservoir, such as a large tank or similar container. Fluid source 102 may be pressurized or, in some embodiments, under a vacuum. In some embodiments, fluid source 102 is at atmospheric pressure. In an embodiment, fluid source 102 is an aerosol container of R-134a refrigerant or HFO1234fy refrigerant. Fluid source 102 may include an integrated valve or a seal that requires puncturing in order to be opened. In some embodiments, fluid routing system 100 may alternatively, or additionally, be configured to transfer fluid from fluid receiving system 108 to fluid source 102.

Fluid transfer member 106 may include fluid transfer body 110. Fluid transfer body 110 may include any device or structure capable of supporting fluid flow. For example, fluid transfer body 110 may include, but is not limited to, one or more flexible or rigid hoses, one or more conduits, pipe, tube, and the like. For example, a hose with appropriate couplings connects to servicing device 104 and an inlet of a refrigeration system. Fluid transfer body 110 may include openings of any suitable shape or size to allow pressurized fluid to enter and/or exit the fluid transfer body at a desired rate of flow. An end of fluid transfer body 110 may include a coupling element (not shown) at least substantially complementary to a coupling element of servicing device 104. In some embodiments, a total length of the fluid transfer body 110 is about twelve inches, about ten inches or about eight inches.

As shown in FIG. 1, measuring device 112 is positioned in between two portions of fluid transfer body 110. Measuring device 112 may provide fluid property readings (for example, temperature and/or pressure readings, etc.) in connection with the fluid flowing through or suspended in the refrigerant system 100. For example, measuring device 112 may provide fluid property readings in connection with fluid receiving system 108. In certain embodiments, measuring device 112 may provide fluid property readings in connection with fluid source 102. In some embodiments, measuring device 112 includes markings that indicate, based on the pressure of the refrigerant system, if the refrigerant system requires refrigerant. In some embodiment, measuring device 112 is not present and fluid transfer body 110 is one conduit (hose).

An opposite end of fluid transfer body 110 may be coupled to a fluid port of fluid receiving system 108. In some embodiments, an end of fluid transfer body 110 includes a coupling element for coupling fluid transfer member 106 to an external device or structure. As shown, fluid transfer body includes quick coupling member 114. Quick coupling member 114 may be at least substantially complementary to a quick coupling member of fluid receiving system 108.

Fluid receiving system 108 may include, but is not limited to, an automobile refrigerant system, a residential refrigerant system, a commercial refrigeration system, or the like. In some embodiments, fluid receiving system 108 is an automobile refrigerant system. The automobile refrigerant system may include an automobile air-conditioning (A/C) system. In some embodiments, a refrigeration system may include an evaporator, condenser, and compressor that circulates refrigerant to cool or otherwise transfer/remove heat from the respective environment.

Adding of fluid to fluid receiving system 108 may charge or recharge the unit. In some embodiments, fluid routing system 100 is used to charge or recharge a refrigeration system (for example, charging an automobile refrigeration system using a can of refrigerant).

Fluid source 102 may include fluid source port 116. Fluid source port 116 may function as an inlet and/or an outlet.

Fluid source port 116 may be an externally threaded cylindrical outlet having a top end wall 118. Top end wall 118 may include a seal that is capable of being pierced and/or punctured.

In some embodiments, fluid source port 116 is coupled to an adapter, valve, servicing device, hose, or the like. In certain embodiments, fluid source port 116 is coupled to a fluid port of servicing device 104. The coupling between fluid source port 116 and the fluid port of servicing device 104 may be least substantially fluid tight. That is, little, or no, fluid may be allowed to escape fluid routing system 100 through the coupling of fluid source port 116 and the fluid port of servicing device 104. Fluid source port 116 may permanently or temporarily couple to a fluid port of servicing device 104.

Figure 3:
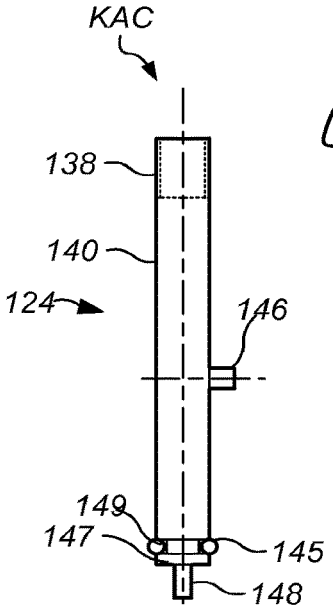
FIG. 3 is a perspective view of an embodiment of a plunger of the servicing device.
Figure 2:
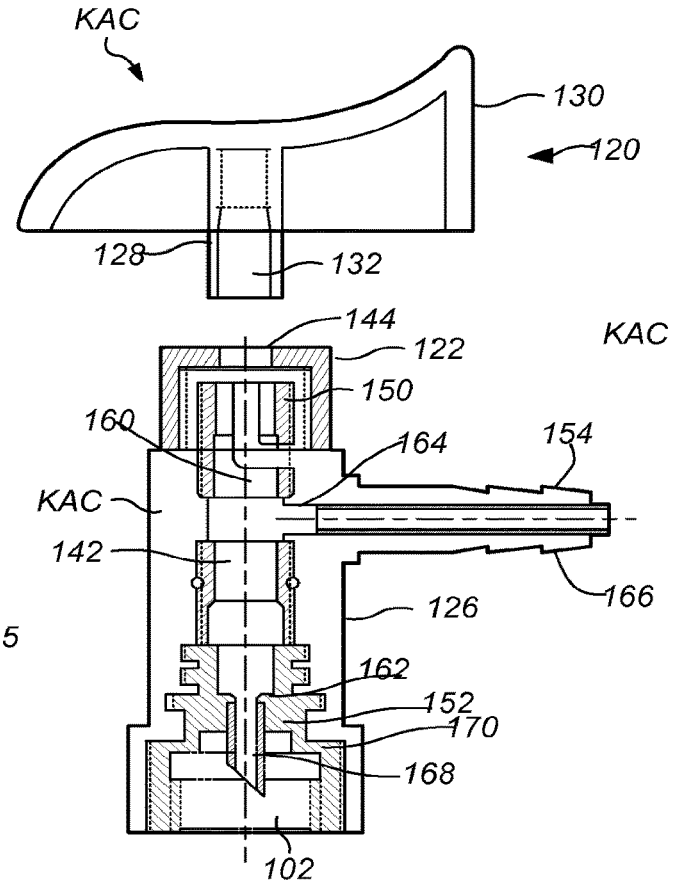
FIG. 2 is an exploded and cross sectional side view of an embodiment of a servicing device.
Figure 4:
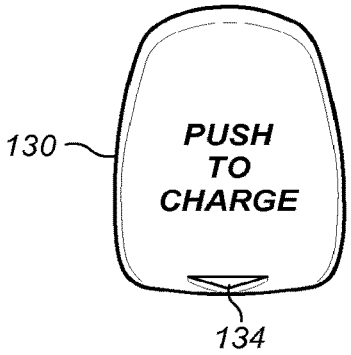
FIG. 4 is a perspective view to view of an embodiment an actuator of the servicing device depicted in FIG. 2.
Figure 5:
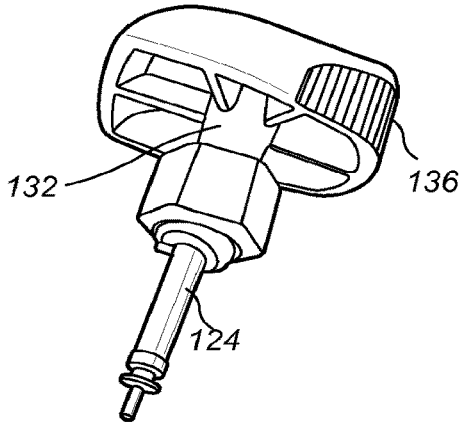
FIG. 5 is a perspective side view of an embodiment of a plunger and actuator of the servicing device assembled.
Figure 6:
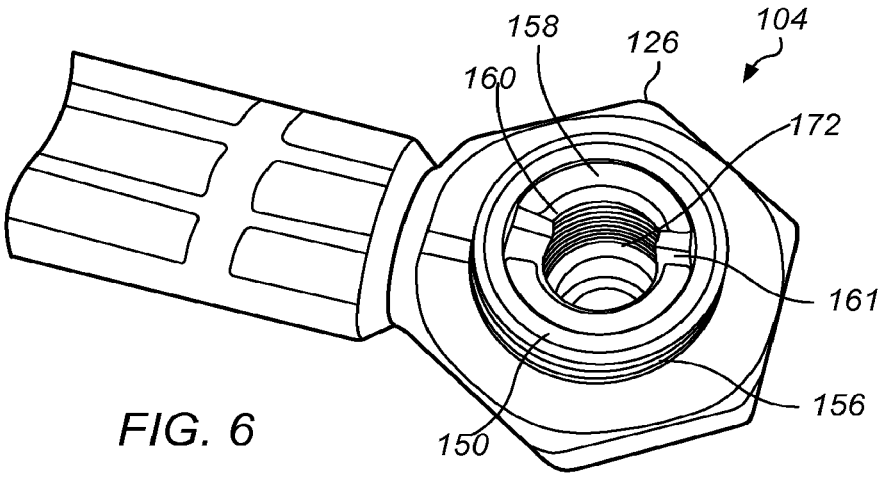
FIG. 6 is a perspective top view of an inside of an embodiment of a coupling member of the servicing device.
Figure 7:
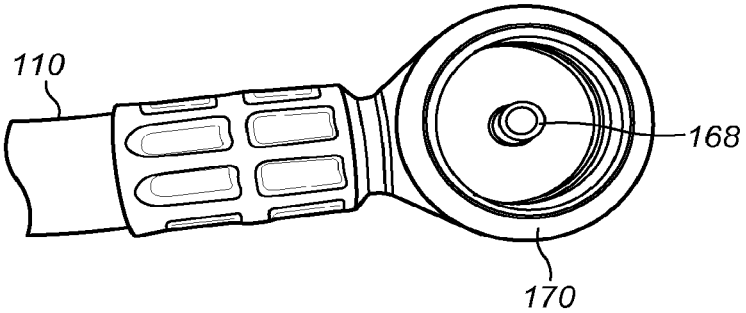
FIG. 7 depicts a perspective bottom view of a coupling element of a servicing device that couples to a fluid source.

FIGS. 2-7 depict embodiments of servicing device 104. FIG. 2 is an exploded cross sectional side view of an embodiment of servicing device 104. FIG. 3 is a perspective view of an embodiment of a plunger of servicing device 104. FIG. 4 is a perspective view of an embodiment of an actuator of servicing device 104. FIG. 5 is a perspective side view of an embodiment of a plunger and actuator of servicing device 104 assembled. FIG. 6 is a perspective top view of an inside of an embodiment of a coupling member of servicing device 104. FIG. 7 depicts a perspective bottom view of coupling element 170.

Servicing device 104 may include actuator 120, coupling member 122, plunger 124, and servicing device body 126. Actuator 120 may be permanently or releasably coupled to plunger 124. Actuator 120 may include cam 130, handle 130, and coupling element 132. Cam 130 may allow handle 130 to move downward when actuated and upward when released. For example, move downward when pressed by a user and upward when released.

Handle 130 may include stop 134 and gripping elements 136. Stop 134 may allow a user to rest a portion of their hand (for example, a thumb or finger) on the handle 130 to facilitate actuation of handle 130. Gripping elements 136 may facilitate gripping of handle 130. Actuator 120 may include any other physical features (for example, ridges, non-slip coating, etc.) that facilitate gripping and/or handling. In some embodiments, actuator 120 does not include gripping elements 136 or stop 134. Handle 130 may also include lettering or symbols to provide instruction on how to operate actuator 120. For example, handle 130 may include the words "Push to Charge".

Coupling element 132 may couple actuator 120 to plunger 124. For example, coupling element 132 may include a set of interior threads arranged in a selected thread pattern. The coupling element of actuator 120 is at least substantially complementary to coupling element 138 of plunger 124. Actuator 120 may be directly coupled, releasably coupled, or an integral part of plunger 124. For example, the set of interior threads of actuator 120 may be at least substantially complementary to exterior threads of plunger 124. During use, actuator 120 may be utilized to actuate servicing device 104. In some embodiments, coupling element 132 is a bore complementary in size to the outer diameter of plunger 124. Plunger 124 may be inserted into coupling element 132 and directly coupled to actuator 120. For example, the plunger may be welded, epoxied, press fit, or the like after insertion in coupling element 132. Plunger 124 includes coupling element 138, plunger body 140.

Servicing device body may include bore 142, opening 144, coupling element 150, first fluid port 152, and second fluid port 154. Servicing device body 126 may be any suitable shape or size. As shown, servicing device body 126 has an elongated, irregular shape. In some embodiments, at least one of the fluid ports may be coupled to fluid source port 116 of fluid source 102.

Opening 144 may be any suitable shape or size. In some embodiments, opening 144 is at least of sufficient size to receive plunger 124. As shown, opening 144 is at least substantially circular, having a diameter of sufficient size to receive the body of plunger 124 and radial protrusion 146 of plunger 124. In some embodiments, opening 144 extends at least substantially in an axial direction through servicing device body 126.

As shown in FIG. 6, coupling element 150 includes exterior threads 156, annular shoulder 158, annular grooves 160, and slot 161. Coupling element 150 may be permanently or releasably coupled to coupling member 122 with exterior threads 156. Threads 156 may be arranged in a selected pattern. In some embodiments, coupling element 150 is at least substantially complementary to coupling member 122. For example, threads 156 of are at least substantially complementary to a set of interior threads of coupling member 122.

Annular grooves 160 may be any suitable shape or size. In some embodiments, annular grooves 160 are at least of sufficient size to receive radial protrusion 146 of plunger body 140. In some embodiments, radial protrusion 146 may be displaced angularly within annular grooves 160. For example, axial rotation of plunger 124 may alter the angular position of radial protrusion 146 within annular groove 160 during use. The angular position of the radial protrusion may be at least 10 degrees, at least 50 degrees, or at least 90 degrees relative to the vertical axis of the plunger. Annular grooves 160 may be spaced about 180 degrees apart, however, other spacing is contemplated. In some embodiments, annular grooves 160 and radial protrusion 146 are not necessary.

Plunger 124 may be adjustable between a released position and an engaged position. In some embodiments, when plunger 124 is adjusted to the engaged position, radial protrusion 146 moves through slot 161 and inserts in groove 160 and fluid communication is free flowing between first fluid port 152 and second fluid port 154. In some embodiments, when plunger 124 is released (for example, moving plunger 124 in downward motion), radial protrusion 146 moves freely inside of bore 142. The amount of fluid communication between first fluid port 152 and second fluid port 154 may be regulated by positioning radial protrusion 146 in various positions of bore 142. For example, if radial protrusion 146 is positioned above second fluid port 154, fluid will flow continuously from first fluid port 152 and the second fluid port. If radial protrusion 146 is positioned in or below second fluid port 154, flow of fluid may be slowed or inhibited.

Referring to FIG. 2, coupling element 150 may be affixed or an integral part of servicing device body 126. Coupling element 150 may have an outer diameter that is less than the outer diameter of the servicing device body. Bore 142 may extend at least substantially in an axial direction through the interior of coupling element 150, servicing device body 126, and first fluid port 152. Bore 142 may include a passage of any suitable shape or size. In some embodiments, bore 142 is at least of sufficient size to receive at least a portion of plunger 124. As shown, bore 142 is at least substantially cylindrical having a diameter at least slightly larger than the diameter of the body of plunger 124. A diameter of bore 142 may be reduced as the bore enters fluid port 152. Such a reduction may form neck 162. Neck 162 may assist in directing flow into valve body 126 from fluid source 102.

Bore 142 may be in fluid communication with second fluid port 154 via passage 164. Second fluid port 154 may function as an inlet and/or an outlet. For example, second fluid port 154 may allow fluid to enter and/or exit servicing device body 126. Passage 164 may be any suitable shape or size. As shown, passage 164 is at least substantially cylindrical.

Second fluid port 154 may include coupling element 166. Coupling element 166 may be configured to couple servicing device 104 to an external device or structure. Servicing device 104 may be permanently or releasably coupled to fluid transfer member 106. In some embodiments, coupling element 166 is at least substantially complementary to a coupling element of fluid transfer member 106. For example, coupling element 166 may include an interior surface weldable to an exterior surface of fluid transfer member 106. In some embodiments, coupling element 166 may be threads in passage 164 that are complimentary to one or more coupling members (for example, a hose fitting, and/or adaptor).

Bore 142 may be in fluid communication with first fluid port 152. First fluid port 152 may function as an inlet and/or an outlet. For example, first fluid port 152 may allow fluid to enter and/or exit servicing device body 126. First fluid port 152 may include bore 168 and coupling element 170. Bore 168 may be any suitable shape or size. Bore 168 may have a diameter of sufficient size to allow pressurized fluid to enter and/or exit servicing device body 126 at a desired rate of flow. Bore 168 may have a tapered end configured to break a seal of a fluid source by piercing a hole in the seal. In some embodiments, the taper end may be sharp. For example, the tapered end may be used for piercing a hole in a seal of a refrigerant container having a ½ inch ACME can thread type top.

Coupling element 170 may be configured to couple servicing device 104 to an external device or structure. Servicing device 104 may be permanently or releasably coupled to fluid source port 116 with coupling element 170. For example, coupling element 170 may include threads that are complementary to fluid source port 116.

Plunger body 140 may be any suitable shape or size. For example, plunger body 140 may be at least substantially cylindrical. In some embodiments, plunger body 140 is at least partially disposed in bore 142 of servicing device body 126. Plunger body 140 may be inserted through opening 144 such that at least a portion of the plunger body is disposed in bore 142. The dotted lines in FIGS. 2 and 3 indicate how plunger 124 fits in servicing device 104. The diameter of plunger body 140 may be at most slightly less than the diameter of bore 142 such that an annulus is formed between an outer surface of the plunger body and an inner surface of the bore. The annulus may be in fluid communication with fluid receiving system 108 and fluid source 102. In some embodiments, a fluid may flow in a substantially axial direction through the annulus. Fluid may flow from fluid source 102 through bore 142 and then to fluid receiving system 108.

A portion of plunger 124 includes, groove 145, stop 147, and end 148. Groove 145 separates stop 147 from plunger body 140. Gasket 149 may be inserted into groove 145 to form a seal. Plunger stop 147 may abut neck 162 when actuator 120 is in a released position. When plunger stop 147 abuts neck 162, protrusion 146 is aligned with passage 164 of second fluid port 154 and fluid communication between first fluid port 152 and second fluid port 154 is inhibited. End 148 may extend into bore 168. End 148 holds and aligns a biasing member (not shown) that provides resistance when pushing down on actuator 120. In some embodiments, biasing member is a spring.

After plunger 124 is inserted in servicing device body 126, coupling member 122 may be used to inhibit the unintentional release of fluid and/or plunger 124 from servicing device body 126. Coupling member 122 may include any suitable components, for example gaskets. As shown, coupling member 122 includes nut 172 shown in FIG. 1.

In some embodiments, servicing device 104 may be assembled by inserting plunger 124 in servicing device body 126 and tightening nut 172 of coupling member 122 to coupling element 150 of servicing device body 126. Plunger 124 may be then coupled to actuator 120. Movement of actuator 120 may move plunger 124 to released, engaged, or locked position.

In some embodiments, plunger 124 may be a locked in an open position. Plunger 124 may be in a locked position when axial movement of the plunger is at least partially inhibited. Plunger 124 may be inhibited or be at least substantially inhibited when radial protrusion 146 is moved out of alignment with groove 160. For example, when radial protrusion 146 is pushed in slot 161 and then rotated into annular groove 160. Positioning of protrusion 146 in annular groove 160 holds plunger 124 in an open position. Adjusting plunger 124 from an unlocked position to a locked position may include exerting torque on plunger 124 when radial protrusion 146 is disposed in annular groove 160, such that the radial protrusion is moved out of alignment with slot 161.

To couple service device 104 to fluid source 102, actuator 120 may be in a released (non-charging) position. In the released position, stop 147 abuts neck 162. Coupling element 170 may be threaded onto fluid source port 116 and tapered end of bore 168 may pierce top wall 118 of the fluid source to open fluid source 102. As refrigerant flows from fluid source into bore 168, pressure is applied to actuator 120 to position the actuator in a charging position (for example, pushing handle 130 downward). Such pressure moves plunger 124 upward in bore 142 to allow fluid to flow into the bore. As plunger 124 moves past passage 164 of second fluid port 154, fluid flow is established between the first fluid port and the second fluid port. By adjusting actuator 120, fluid flow from first fluid source 102 through servicing device 104, and then to fluid receiving system 108 is regulated. In some embodiments, the plunger end 148 and/or plunger body 140 are hollow. In some embodiments, plunger end 148 is tapered and sufficiently sharp to pierce a seal of fluid source 102.

In some embodiments, servicing device 104 may be connected to fluid source 102 and to fluid receiving system 108 (see, for example, FIG. 1). When attached to fluid source 102 and fluid receiving system 108 servicing device 104 may be in a locked or released position. Fluid source 102 may be held in a user's hand (for example, in a palm of the user's hand). In the released position, plunger 124 may move freely through bore 142 when pressure is applied to actuator 120. Actuator 120 may be pushed using a portion of the hand that is holding the fluid source (for example, using a thumb or finger of the hand). In some embodiments, when actuator 120 is moved downward (charging position), plunger 124 moves upward through bore 142 until protrusion 146 aligns with slot 161. Once aligned with slot 161, actuator 120 is rotated with the same hand until protrusion 146 moves through slot 161 into groove 160 to lock plunger 124. Thus, the user is able to hold fluid source 102 and to operate regulate flow of refrigerant with the same hand.

In some embodiments, servicing device 104 may be adapted to allow measurement of one or more parameters of the receiving system while inhibiting communication between the fluid source port and the measuring system or the fluid source port and the receiving system. Inhibiting communication to the fluid source allows the servicing device to be used to measure one or more parameters of the receiving system (for example, a refrigeration system such as an automobile refrigeration system) prior to attaching the servicing device to the fluid source (for example, a refrigerant cylinder). For example, when actuator 120 is in a non-charging position, gasket 149 of plunger 124 seals bore 142 and first fluid port 152, thus a pressure of the refrigerant system using measuring device 112 may be obtained using servicing device 100.

Figure 8:
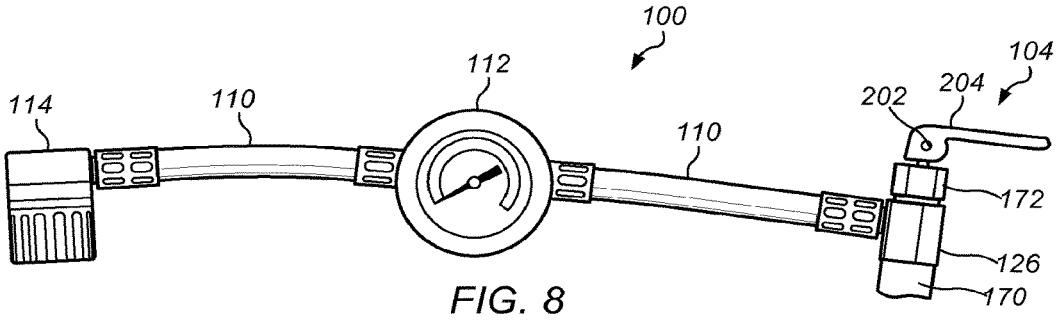
FIG. 8 is a perspective view of an embodiment a fluid routing system with another servicing device.
Figure 11:
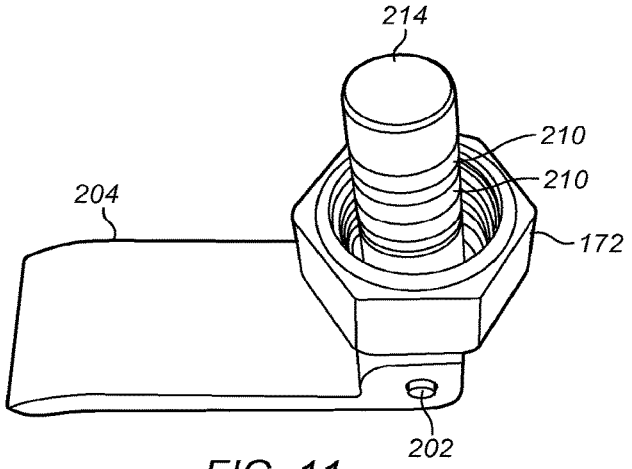
FIG. 11 is a perspective bottom view of an embodiment of the servicing device without the servicing device body and the coupling element that couples to a fluid source.
Figure 10:
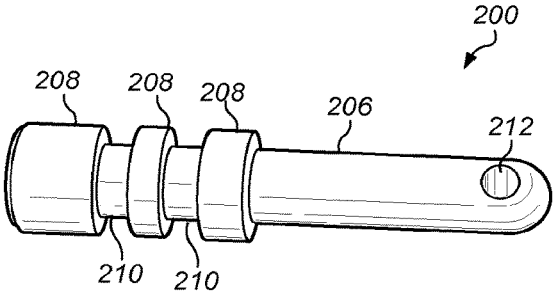
FIG. 10 is a perspective view of an embodiment of a plunger of the servicing device of FIG. 9.
Figure 9:
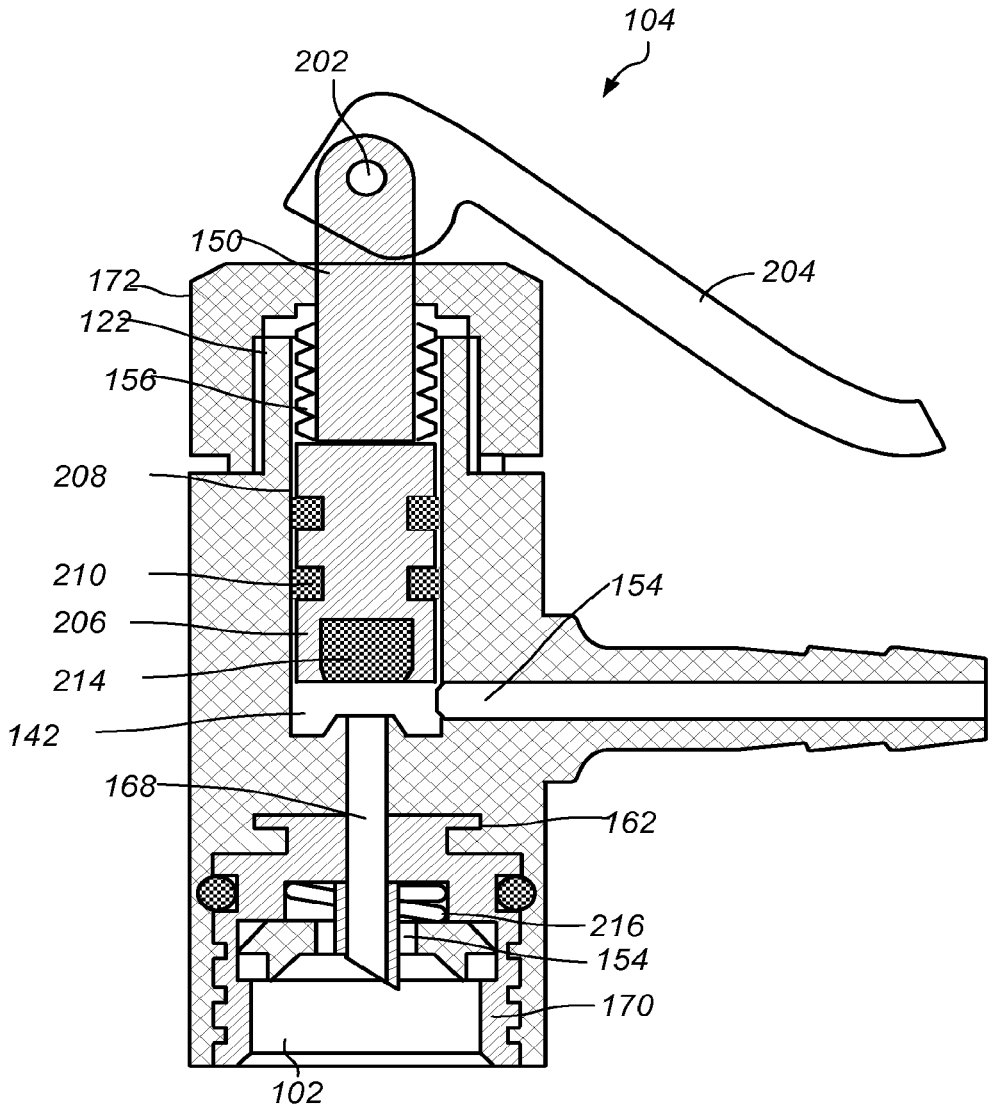
FIG. 9 is a cross-sectional side view of an embodiment of the service device depicted in FIG. 8.

FIG. 8 is a perspective side view of an embodiment of a fluid routing system with another servicing device 104. FIGS. 10-11 depict perspective views of servicing device 104 shown in FIG. 8. FIG. 9 depicts a cross-sectional view of servicing device 104. FIG. 10 depicts a perspective view of plunger body 140. FIG. 11 depicts a bottom view of servicing device 104 without service device body 126 and coupling element 170. Servicing device 104 may include actuator 120, coupling element 150, coupling element 170, plunger 200, and servicing device body 126. Actuator 120 may be permanently or releasably coupled to plunger 124.

Coupling element 150 includes exterior threads 156. Coupling element 150 may be permanently or releasably coupled to coupling member 122 with exterior threads 156. Threads 156 may be arranged in a selected pattern. In some embodiments, coupling element 150 is at least substantially complementary to coupling member 122. For example, threads 156 of are at least substantially complementary to a set of interior threads of coupling member 122. Servicing device body and coupling elements 170 and 172 are the same as described in FIGS. 1-7.

Actuator 120 may include pin 202 and lever 204. Cam 202 may allow lever 204 to move downward when actuated and upward when released. For example, move downward when pressed by a user and upward when released.

Plunger 200 includes plunger body 206, ridges 208, grooves 210 and opening 212. As shown, plunger body is cylindrical in shape, however, any shape that is complementary to bore 142 may be used. End 214 of plunger body 206 may abut neck 162 when lever 204 is in a released position. Ridges 208 may have the same or different widths or areas. The width of ridges 208 may be complementary to the width of various portions of bore 142. Ridges 208 may be spaced apart to form grooves 210. Grooves 210 may hold gaskets (not shown). Gaskets positioned in grooves 210 may assist in aligning plunger body 206 in bore 142 (shown in FIG. 2).

End 214 may form a seal in bore 142. End 214 may be made any material that allows a seal in bore 142 to be formed. For example, end 214 may be made of metal, rubber or a plastic material. Forming a seal in bore 142 may inhibit premature release of fluid from second fluid port 154 and/or assist in regulating flow of fluid through the bore. For example, when lever 204 is in an actuated (charging) position, end 214 may be above first fluid port 152 and second fluid port 154 (shown in FIG. 9) of servicing device 104 to establish fluid communication in the fluid routing system. Movement of actuation of lever 204 to a partial charging position plunger 200 moves upward or downward through bore 142 of servicing device 104 and end 214 moves past second fluid port 154 to allow fluid to flow to the fluid port.

Opening 214 has a shape complementary to pin 202. Insertion of pin 202 into opening 212 connects lever 204 to plunger 200. Pin 214 may be welded, epoxied and/or otherwise affixed in opening 212. Connection of lever 204 to plunger 200 allows actuation of plunger 200 during use.

To couple service device 104 to fluid source 102, actuator 120 may be in a released (non-charging) position. In the released position, plunger end 214 abuts neck 162 in service device bore 142. Coupling element 170 may be threaded onto fluid source port 116 and tapered end of bore 168 may pierce top wall 118 of the fluid source to open fluid source 102. Fluid source 102 may be positioned in a user's hand. As refrigerant flows from fluid source into bore 168, pressure is applied to lever 204 to position the actuator in a charging position (for example, downward). In some embodiments, the pressure is applied using a portion of the hand (for example, a thumb or finger of the hand) that is holding the fluid source. Such pressure moves plunger 200 upward in bore 142 to allow fluid to flow into the bore. As plunger end 214 move past passage 164 of second fluid port 154, fluid flow is established between the first fluid port and the second fluid port. By adjusting lever 204, fluid flow from first fluid source 102 through servicing device 104, and then to fluid receiving system 108 is regulated. In some embodiments, the plunger end 214 and/or plunger body 140 are hollow. In some embodiments, plunger end 214 is tapered and sufficiently sharp to pierce a seal of fluid source 102.

In some embodiments, servicing device 104 may be adapted to allow measurement of one or more parameters of the receiving system while inhibiting communication between the fluid source port and the measuring system or the fluid source port and the receiving system. Inhibiting communication to the fluid source allows the servicing device to be used to measure one or more parameters of the receiving system (for example, a refrigeration system such as an automobile refrigeration system) prior to attaching the servicing device to the fluid source (for example, a refrigerant cylinder). For example, when actuator 120 is in a non-charging position, gaskets of plunger 200 seals bore 142 and first fluid port 152, thus a pressure of the refrigerant system using measuring device 112 may be obtained using servicing device 100.

In some embodiments, servicing device 104 includes a biasing member 216. In some embodiments, biasing member is a spring. Use of a biasing member provides tension when applying pressure to lever 204 of actuator 120. The biasing member also assists in moving actuator 120 back to a released position when lever 204 is released. In some embodiments, actuator 130 in FIG. 1 is used instead of actuator 204 in FIGS. 8 and 9.

It is contemplated that other suitable means for providing an actuating force to the valve are considered to be within the scope of the present invention. For example, means for actuating the valve with the handle are considered within the scope of the present invention, including, but not limited to, hydraulic, mechanical, or pneumatic members that could be used to link the plunger portion of the valve with the handle. In addition, the valve actuator may be adapted to receive other actuation forces, such as, for example, pulling, rotating, and/or pushing forces.

Figure 12:
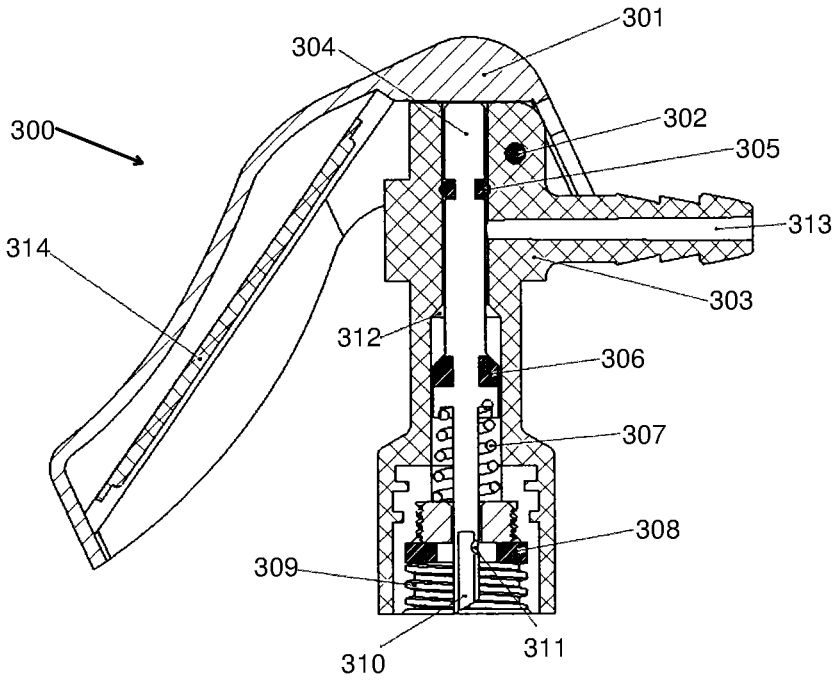
FIG. 12 is a cross sectional side view of an embodiment of a servicing device.

FIG. 12 depicts a cross-sectional view of servicing device 300. Servicing device 300 may include actuator or lever 301, pivoting pin 302, valve body 303, plunger 304, O-ring seal 305, plunger seal 306, biasing member-spring 307, washer seal 308, can adaptor threads 309, piercing/poking tip of plunger 310, cross bored orifice—fluid communications to first fluid port 311, sealing surface 312, fluid communications to second fluid port 313, and anti-theft security tag 314.

Referring to FIG. 12, the downward traveling plunger with piercing pin 310 opens two types of refrigerant sources. The sources include those which require a seal to be pierced and those that consist of a self sealing valve which require a pin to be depressed. The downward traveling plunger with piercing pin 310 reduces complexity of the mechanism, thereby reducing the number of components, simplifying assembly, and reducing overall cost. The servicing device 300 allows for self containment of anti-theft security tags within the handle.

In an embodiment, this disclosure provides a device for servicing a refrigeration system. The device comprises a body having a first fluid port, wherein the first fluid port operatively couples to a fluid source; a plunger, the plunger capable of piercing a seal of the fluid source and/or depressing a valve of the fluid source; a second fluid port, wherein the second fluid port operatively couples to a fluid port of refrigeration system; and a plunger seal at least partially disposed in the passage of the body, the plunger seal is configured to seal the second fluid port during use, wherein the plunger is adjustable between an open and closed position during use. The device also comprises an actuator coupled to the body, and wherein, during use, downward movement of the actuator moves the plunger, opening the valve of the fluid source and/or piercing the seal of the fluid source while simultaneously adjusting the position of the plunger seal to allow fluid communication between the first fluid port and the second fluid port. The fluid source is configured to be hand-held and the downward movement of the actuator is performed by a portion of the hand that is holding the fluid source.

In another embodiment, this disclosure provides a method of servicing a refrigeration system using the above device.

A pressure of receiving system 108 may be assessed and the level of refrigerant in the receiving system may be determined. In some embodiments, the measurement device 112 may indicate the need for additional refrigerant, for example, by displaying a measurement reading. If a need for additional refrigerant is determined, servicing device 104 may be used to charge receiving system 108 with fluid from fluid source 102. Alternating between providing refrigerant to the refrigeration system and measuring a parameter of the refrigeration system may be performed by applying an actuation force to plunger 124 or plunger 200 by pushing and releasing actuator 120 as desired.

It is appreciated that servicing device 104 may be adapted to selectively switch between the charging mode of operation and the measuring mode of operation in alternative ways. For example, it is contemplated that servicing device 104 may be adapted such that an actuation force is applied for measuring operation, and no actuation force is applied to plunger 124 or plunger 200 for charging operation.

In some embodiments, the servicing device may be sold and/or packaged as a complete product or as part of a kit. The kit may also include, a fluid source (for example, a can of refrigerant and/or refrigerant containing additives), additional measuring devices (for example, temperature gauge), safety glasses, towels, funnels, an activating light source (for example, a UV light), or combinations thereof. The kit may be packaged in a carrying case with pre-formed segments to hold the components of the kit. In some embodiments, the carrying case may be plastic and/or include a handle. In some embodiments, the pre-formed segments may be removable.

In some embodiments, a refrigerant system is serviced using servicing device 104 described herein. Refrigerant system, in some embodiments, is an automobile air conditioning system. Servicing device may be coupled to refrigerant system using a hose or other suitable conduit to a low pressure side of a refrigerant system. A pressure and/or level of refrigerant of the refrigerant system may be determined. If the refrigerant level is adequate, the servicing device may be disconnected. If the refrigerant level is low, the servicing device may be connected to a fluid source (for example, a can of automobile refrigerant). While holding the servicing device 104 attached to the refrigerant can, the handle (actuator) or lever (actuator) of the service device may be depressed sufficiently (for example, pressed with a thumb of the hand) to open the fluid source. Fluid (for example, refrigerant) from the fluid source may flow from the fluid source through the service device and into the refrigerant system. The handle or lever may be released and the pressure and level of refrigerant in the refrigerant system may be determined. The process may be repeated until the level of refrigerant in the refrigerant is adequate.

While holding the can, the handle or lever may be depressed to various depths with the same hand to regulate the flow of refrigerant from the fluid source to the refrigerant system. In some embodiments, the handle may be rotated and locked to allow substantially continuous flow of refrigerant from the fluid source to the refrigerant system (for example, from the can of automobile refrigerant to an automobile refrigerant system). Once an adequate level is reached the servicing device may be disconnected from the refrigerant system and then from the fluid source. The ability to use one hand allows the user to manipulate other tools or products that are needed during the servicing of the refrigerant system. With a locking actuator, the user is able allow the can to stand freely and not require any hands to hold the can. Thus, the refrigerant charging system allows more efficient use of the time used for charging the refrigerant system.

The depiction of the housing, the valve actuator, and the valve are intended to be illustrative only, and not limiting. It is appreciated that the size and shape of the housing may vary markedly without departing from the intended scope of the present invention. These and other modifications to the above-described embodiments of the invention may be made without departing from the intended scope of the invention. It will be apparent to those skilled in the art that various other modifications and variations can be made in the construction, configuration, and/or operation of the present invention without departing from the scope or spirit of the invention.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. A device for servicing a refrigeration system, comprising:

a body comprising:

a first fluid port, wherein the first fluid port operatively couples to a fluid source;

a second fluid port, wherein the second fluid port operatively couples to a fluid port of refrigeration system; and a plunger having a piercing member, wherein the plunger is at least partially disposed in a passage of the body, a first portion of the plunger is configured to seal the second fluid port during use, wherein the plunger is adjustable between an open and closed position during use; and wherein the plunger is capable of opening two types of fluid sources by piercing a seal of the fluid source or by depressing a valve of the fluid source;

an actuator coupled to the body, wherein the actuator is configured such that, during use, downward movement of the actuator moves the first portion of the plunger to allow fluid communication between the first fluid port and the second fluid port, and wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigeration system, wherein the fluid source is configured to be hand-held and the downward movement of the actuator is performed by a portion of the hand that is holding the fluid source.

2. The device of claim 1, further comprising a sealing member coupled to the plunger, wherein the sealing member is capable of sealing at least a portion of the passage.

3. The device of claim 1, wherein, during use, simultaneous engagement of the piercing member with fluid source seal and downward movement of the actuator allows substantially continuous fluid communication between the fluid source and the body; and/or wherein, during use, upward movement of the actuator inhibits fluid communication between the fluid source and the body.

4. The device of claim 1, wherein the one end of the handle is pivotably coupled to the plunger, and wherein the one end of the handle has a cam that can cause the plunger to move linearly in the passage when the handle is actuated downward.

5. A method of servicing a refrigeration system, wherein the method comprises:

providing a device for servicing the refrigeration system, wherein the device comprises:

a body comprising:

a first fluid port, wherein the first fluid port operatively couples to a fluid source;

a second fluid port, wherein the second fluid port operatively couples to a fluid port of the refrigeration system; and a plunger having a piercing member, wherein the plunger is at least partially disposed in a passage of the body, a first portion of the plunger is configured to seal the second fluid port during use, wherein the plunger is adjustable between an open and closed position during use; and wherein the plunger is capable of opening two types of fluid sources by piercing a seal of the fluid source or by depressing a valve of the fluid source;

an actuator coupled to the body, wherein the actuator is configured such that, during use, downward movement of the actuator moves the first portion of the plunger to allow fluid communication between the first fluid port and the second fluid port, and wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigeration system, wherein the fluid source is configured to be hand-held and the downward movement of the actuator is performed by a portion of the hand that is holding the fluid source, operatively coupling the first fluid port to the fluid source;

operatively coupling the second fluid port to the fluid port of the refrigeration system; and actuating the handle downward to cause fluid communication between the first fluid port and the second fluid port.

6. A device for servicing a refrigeration system, comprising:

a body comprising:

a first fluid port, wherein the first fluid port operatively couples to a fluid source;

a plunger, the plunger capable of opening two types of fluid sources by piercing a seal of the fluid source and/or by depressing a valve of the fluid source;

a second fluid port, wherein the second fluid port operatively couples to a fluid port of the refrigeration system; and a plunger seal at least partially disposed in a passage of the body, the plunger seal being configured to seal the second fluid port during use, wherein the plunger is adjustable between an open and closed position during use;

an actuator coupled to the body, wherein the actuator is configured such that, during use, downward movement of the actuator moves the plunger, opening the valve of the fluid source and/or piercing the seal of the fluid source while simultaneously adjusting the position of the plunger seal to allow fluid communication between the first fluid port and the second fluid port, wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigeration system, wherein the fluid source is configured to be hand-held and the downward movement of the actuator is performed by a portion of the hand that is holding the fluid source.

7. The device of claim 6, wherein the one end of the handle is pivotably coupled to the plunger, and wherein the one end of the handle has a cam that can cause the plunger to move linearly in the passage when the handle is actuated downward.

8. A device for servicing a refrigerant system, the device comprising:

a body comprising:

a first fluid port, wherein the first fluid port is adapted to be coupled to a fluid port of a fluid source;

a second fluid port, wherein the second fluid port is adapted to be coupled to the refrigerant system;

a passage in fluid communication with the first and second fluid ports; and a plunger at least partially disposed in the passage, wherein the plunger is adjustable between a released position and an engaged position, and wherein the plunger is adapted to open a type of fluid source having a seal by piercing the seal of the fluid source and adapted to open a fluid source having a valve which is open when depressed by depressing the valve of the fluid source;

an actuator mechanically coupled to the body and to the plunger and disposed such that movement of the actuator moves the plunger to establish substantially continuous fluid communication between the first fluid port and the second fluid port, wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigerant system.

9. The device of claim 8, further comprising a sealing member coupled to the plunger for sealing at least a portion of the passage.

10. The device of claim 8, wherein, during use, simultaneous engagement of the piercing member with fluid source seal and downward movement of the actuator allows substantially continuous fluid communication between the fluid source and the body; and/or wherein, during use, upward movement of the actuator inhibits fluid communication between the fluid source and the body.

11. The device of claim 8, wherein the plunger is disposed in the passage of the body such that the plunger is at least substantially free to rotate within a selected angular range;

wherein a magnitude of the selected angular range is at least about 90 degrees.

12. The device of claim 8, wherein the plunger comprises one or more gaskets for inhibiting unintentional release of fluid from the body during use.

13. The device of claim 8, wherein first fluid port comprises a coupling element at least substantially complementary to a coupling element of the fluid port of the fluid source.

14. The device of claim 8, further comprising a biasing member, wherein the plunger is positioned inside the biasing member.

15. The device of claim 8, wherein the one end of the handle is pivotably coupled to the plunger, and wherein the one end of the handle has a cam that can cause the plunger to move linearly in the passage when the handle is actuated downward.

16. A method of servicing a refrigeration system, wherein the method comprises:

providing a device for servicing the refrigeration system, wherein the device comprises:

a body comprising:

a first fluid port, wherein the first fluid port operatively couples to a fluid source;

a plunger, the plunger capable of opening two types of fluid sources by piercing a seal of the fluid source and/or by depressing a valve of the fluid source;

a second fluid port, wherein the second fluid port operatively couples to a fluid port of the refrigeration system; and a plunger seal at least partially disposed in a passage of the body, the plunger seal being configured to seal the second fluid port during use, wherein the plunger is adjustable between an open and closed position during use;

an actuator coupled to the body, wherein the actuator is configured such that, during use, downward movement of the actuator moves the plunger, opening the valve of the fluid source and/or piercing the seal of the fluid source while simultaneously adjusting the position of the plunger seal to allow fluid communication between the first fluid port and the second fluid port, wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigeration system, wherein the fluid source is configured to be hand-held and the downward movement of the actuator is performed by a portion of the hand that is holding the fluid source;

operatively coupling the first fluid port to the fluid source;

operatively coupling the second fluid port to the fluid port of the refrigeration system; and actuating the handle downward to cause fluid communication between the first fluid port and the second fluid port.

17. A method of servicing a refrigerant system, wherein the method comprises:

providing a device for servicing the refrigerant system, wherein the device comprises:

a body comprising:

a first fluid port, wherein the first fluid port is adapted to be coupled to a fluid port of a fluid source;

a second fluid port, wherein the second fluid port is adapted to be coupled to the refrigerant system;

a passage in fluid communication with the first and second fluid ports; and a plunger at least partially disposed in the passage, wherein the plunger is adjustable between a released position and an engaged position, and wherein the plunger is adapted to open a type of fluid source having a seal by piercing the seal of the fluid source and adapted to open a fluid source having a valve which is open when depressed by depressing the valve of the fluid source;

an actuator mechanically coupled to the body and to the plunger and disposed such that movement of the actuator moves the plunger to establish substantially continuous fluid communication between the first fluid port and the second fluid port, wherein the actuator comprises a handle that is configured to rotate about one end of the handle when the handle is actuated downward and cause the plunger to move linearly in the passage;

a pressure gauge; and at least two conduits, a first of the conduits is positioned between the second fluid port and the pressure gauge and a second conduit is positioned between the pressure gauge and a coupling member that is complementary to a coupling member of the refrigerant system;

coupling the first fluid port of the body to the fluid port of the fluid source;

coupling the coupling member that is complementary to the coupling member of the refrigerant system; and actuating the handle downward to cause continuous fluid communication between the first fluid port and the second fluid port.

* * * * *